United States Patent [19]

Swisher, Jr. et al.

[11] 4,140,420

[45] Feb. 20, 1979

[54] PORTABLE GRADE AVERAGING APPARATUS

[75] Inventors: George W. Swisher, Jr.; Thomas L. Steele, both of Oklahoma City, Okla.

[73] Assignee: CMI Corporation, Oklahoma City, Okla.

[21] Appl. No.: 887,004

[22] Filed: Mar. 16, 1978

[51] Int. Cl.[2] ..... E01C 19/00

[52] U.S. Cl. ..... 404/84; 37/108 R; 37/DIG. 1; 172/4.5; 180/9.5; 180/41; 280/6.1; 299/56; 299/1

[58] Field of Search ..... 404/84; 299/56, 1; 37/108 R, DIG. 1, DIG. 20, DIG. 14; 172/4.5; 180/9.5, 41; 280/DIG. 1, 6 R, 6.1, 6.11

[56] References Cited

U.S. PATENT DOCUMENTS

| | | | |
|---|---|---|---|
| 3,111,070 | 11/1963 | Pollitz | 404/84 |
| 3,272,099 | 9/1966 | Drake | 404/84 |
| 3,323,427 | 6/1967 | Schrimper | 404/84 |
| 3,595,144 | 7/1971 | Rink | 404/84 |
| 3,771,892 | 11/1973 | Munyon | 404/84 |
| 3,807,887 | 4/1974 | Tate | 404/84 |
| 3,811,787 | 5/1974 | Beaty | 404/84 |
| 3,846,035 | 11/1974 | Davin | 404/84 |
| 3,879,149 | 4/1975 | Smith | 404/84 X |
| 4,029,165 | 6/1977 | Miller | 404/84 X |
| 4,041,623 | 8/1977 | Miller | 404/84 X |

*Primary Examiner*—Nile C. Byers, Jr.
*Attorney, Agent, or Firm*—Dunlap, Codding & McCarthy

[57] ABSTRACT

A portable grade averaging apparatus comprising an averaging bar assembly that serves as an elevation control reference for a track supported road working machine, one end of the averaging bar assembly being pivotally supported by a forward walking beam and the other end of the averaging bar being pivotally supported by a rear track assembly that serves as a track walking beam. A grade sensor assembly supported on one side by the road working machine contactingly engages the averaging bar assembly for directing the elevation of one side of the road working machine to establish the elevation of a working tool supported by the road working machine. A lifting bracket supported by the road working machine serves to lift the grade averaging apparatus into a grade clearing position while the machine is being maneuvered into a cutting position.

21 Claims, 4 Drawing Figures

PORTABLE GRADE AVERAGING APPARATUS

BACKGROUND OF THE INVENTION

1. Field of the Invention

The present invention relates generally to road working machines and, more particularly, but without limitation, to an apparatus for providing a portable elevation control reference.

2. Prior Art

When a road working machine having a work piece, such as a planing cutter, is utilized to perform a surfacing operation on a roadway, such as a surface planing operation, an elevation control reference may be disposed along the roadway and adjacent the work piece when the finished surface is to have a predetermined elevation. One of the more common means for establishing an elevation control reference is a conventional stringline setup positioned alongside the roadway. Sensing means on the road working machine continuously senses the predetermined elevation of the stringline above grade and provides an elevation control signal to elevation control means on the road working machine. In turn, the elevation control means maintains the work piece at a predetermined working elevation, or cutting depth, in relation to the grade of the roadway. Thus, a uniform finish grade can be formed which is substantially free of high or low spots. In some instances, an existing curb alongside the roadway may be utilized in place of a stringline as the elevation control reference, if the grade elevation of the curb is generally uniform in relation to that of the roadway.

Stringline setups have more than proved their worth when utilized as an elevation control reference for making an initial pass down the roadway. It is relatively simple to construct a stringline setup along the shoulder portion of a roadway in a manner convenient to the positioning of the sensing means. However, as subsequent passes are made along the roadway, it becomes highly impractical to utilize the initial stringline setup, and it is not economical to construct a separate stringline setup for each pass made by the road working apparatus. This is particularly true when the roadway is relatively wide.

There are also many occasions when a planing operation is required to remove a specified amount of material from an existing roadway. An example would be a planing specification that requires the removal of the surface to a specified depth measured in inches below the existing roadway surface.

Whether the roadway working machine is to remove surface material by referring to a stringline or to the existing surface itself, it would be desirable to have an elevation control reference which is portable, or which, more or less, is always positioned adjacent the sensing means. Although not meeting this description, walking beam assemblies connected alongside a road working machine have been utilized in some instances to provide an elevation control reference which is roughly indicative of the desired finish grade. A walking beam assembly of this latter type is disclosed in U.S. Pat. No. 3,414,327, issued to Austin.

In the Austin patent, a grade elevation sensor assembly is utilized for determining the average grade elevation of the roadway forward of the work piece. The grade elevation sensor assembly provides a control signal indicative of this average grade elevation, and the control signal does substantially maintain the work piece at a predetermined working depth. However, since the grade elevation sensor assembly senses the grade elevation of the roadway forwardly of the work piece, the work piece will generally be maintained at a working depth indicative of the average elevation forward of the work piece as opposed to the average grade elevation surrounding the work piece. Thus, the resulting finish grade formed via the work piece will not be as uniform as if the work piece had been positioned at a working depth indicative of the average grade elevation of the roadway near the work piece.

An additional problem with conventional portable walking beam assemblies is that they restrict the maneuverability of the road working machine. In the use of a road working machine employing a planing cutter, by way of example, the machine frequently must make multiple cutting passes along the roadway. At the end of each pass, the machine must be manuevered into position to make the next cutting pass. It is not unusual to find that the machine must be turned around and repositioned to travel in the opposite direction, and such turn around often must be performed in tight quarters having minimum clearance and maneuvering room. When a conventional portable control reference apparatus is attached to the road working machine, more turn around area must be provided in which the machine is repositioned, or the control reference apparatus must be removed before turning the machine, and remounted once the machine is repositioned.

SUMMARY OF THE INVENTION

The present invention provides a portable grade averaging apparatus for providing an elevation control reference that is adjacent a work piece and which is continuously contacted by a grade sensor, the elevation control reference being indicative of the average grade of selected surfaces near the work piece. More particularly, the apparatus utilizes a rear drive track of the road working machine substantially as a track walking beam, as well as a forward walking beam positioned forward of the work piece, with an averaging bar pivotally supported by the forward walking beam and the track walking beam. The rear drive track provides a rear elevation reference indicative of the average grade elevation rearwardly of the work piece, and the forward walking beam provides a front elevation reference indicative of the average grade elevation forward of the work piece, with the averaging bar generally providing the elevation control reference indicative of the average of the rear elevation reference and the front elevation reference. The apparatus is supported by the rear drive track at a disposition clear of the nearby terrain, and a lifting bracket supported by the road working machine disposes the grade averaging apparatus in a grade clearing position when the machine is being maneuvered into a cutting position.

Accordingly, it is an object of the present invention to provide a grade averaging apparatus connected to a road working machine such that a portion of the road working machine forms a walking beam for the grade averaging apparatus, providing an elevation control reference indicative of the average of the grade elevations forwardly and rearwardly of a work piece connected to the road working machine.

Another object of the present invention is to utilize at least one of the rear drive tracks of the road working machine as a grade averaging portion of the grade averaging apparatus.

Yet another object of the present invention is to provide a self-storing, portable grade averaging apparatus that affords greater maneuverability for the road working machine.

A further object of the present invention is to provide a portable grade averaging apparatus that is simple to construct and manufacture, and which requires minimum upkeep and repair.

Other objects, advantages and features of the present invention will become apparent from the following detailed description when read in conjunction with the accompanying drawings and appended claims.

DESCRIPTION OF THE PREFERRED EMBODIMENT

Figure 1:
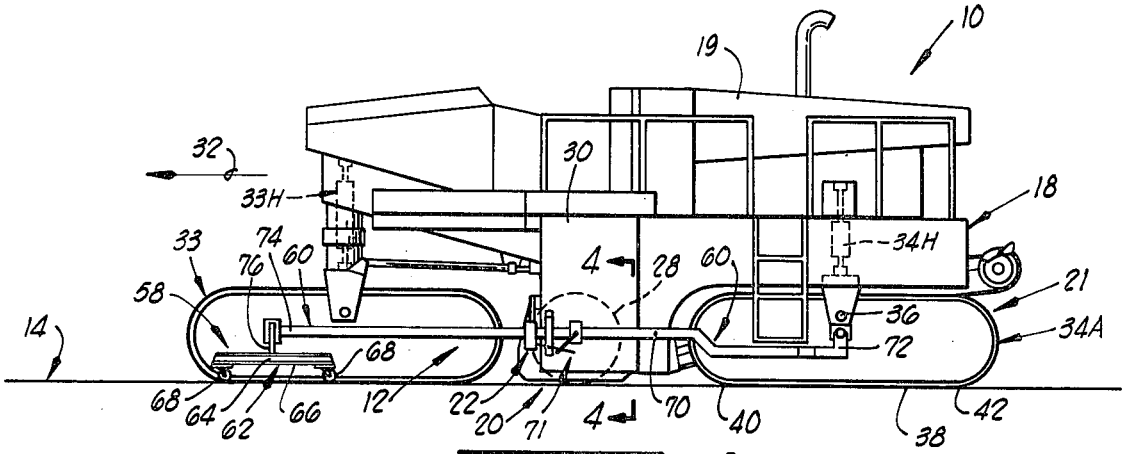
FIG. 1 is a side elevational view of the grade averaging apparatus of the present invention in an assembled position with a road working machine.
Figure 2:
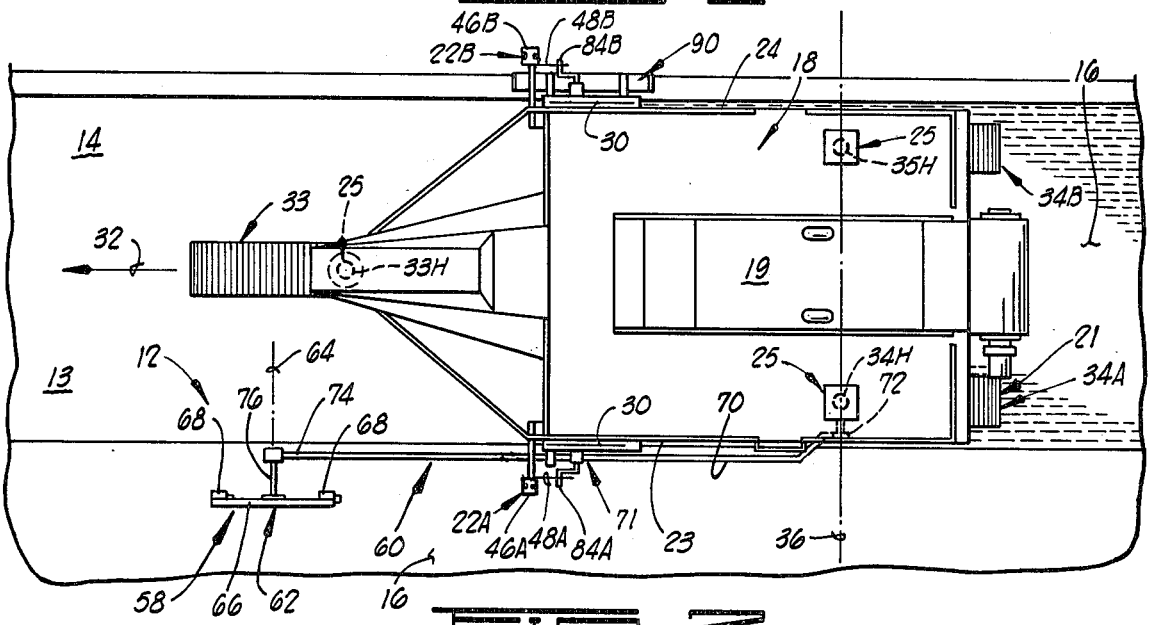
FIG. 2 is a plan view of the grade averaging apparatus and the road working machine shown in FIG. 1.

Referring to the figures in general, and to FIGS. 1 and 2 in particular, shown therein is a road working machine 10 assembled in combination with a grade averaging apparatus 12 constructed in accordance with the present invention. The road working machine 10 that is shown is a planer apparatus that is generally utilized to perform surfacing or resurfacing operations on an existing, or old, grade 13 of a roadway 14. The grade averaging apparatus 12 is utilized to provide a first elevation control reference generally indicative of, or proportional to, a selected surface whereby a new surface, or finish grade 16, is formed, as will be made more clear below. In the interest of simplifying the drawings included in the present disclosure, details such as hydraulic conduits, electrical lines, and machine controls have not been shown as such are conventional and need not be described for purposes of this disclosure.

An illustrative example of a conventional road working apparatus such as the machine 10 is disclosed in the U.S. Patent Application Ser. No. 672,326, entitled "A Method and Apparatus for Planing a Paved Roadway", assigned to the assignee of the present invention. Even though the present invention is particularly applicable to the planing of a paved roadway, as will be made more apparent below, it should be noted that the present invention is also applicable to other roadway surface operations such as grading, for example. Furthermore, as should be clear to one skilled in the art, even though the road working apparatus related to the above mentioned patent application is disclosed therein as being utilized for planing a paved roadway, it is contemplated that the basic form of such a road working apparatus could, with minor modifications, be used for other road surfacing operations such as, for example, grading.

In a basic form, the road working machine 10 generally comprises a frame 18; a prime mover, such as a diesel power plant 19; a work piece 20 supported by the frame 18; a drive assembly 21 connected to and supporting the frame 18; a grade sensor assembly 22A connected to the frame 18 and supported adjacent the work piece 20 near the left side 23 of the frame 18; another grade sensor assembly 22B connected to the frame 18 and supported adjacent the work piece 20 near the opposite, or right, side 24 of the frame 18; and an elevation control assembly 25, connected to the frame 18 and having portions connected to the drive assembly tracks, as will be described more fully below.

The frame 18 substantially includes the chassis, body panels and, in general, all of the supportive and protective portions and components normally associated with a road working machine such as the machine 10.

The working piece 20 is rigidly attached to the underside of the frame 18 and extends generally transversely to a medial portion of the frame 18, and therefore the work piece 20 also extends generally transversely to the roadway 14. The elevation of the work piece 20, which is the portion of the road working machine 10 that interacts with the roadway 14, is determined by the elevation of the frame 18. Of course, the type of surfacing operation performed on the roadway 14 by the road working machine 10 is determined by the kind of work piece utilized.

Figure 3:
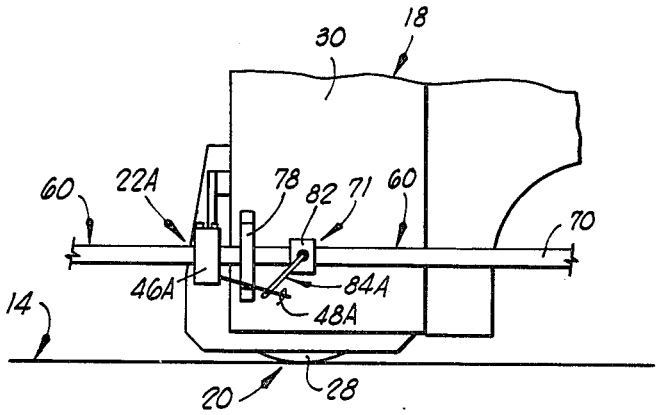
FIG. 3 is a close up view of a portion of the apparatus shown in FIG. 1.
Figure 4:
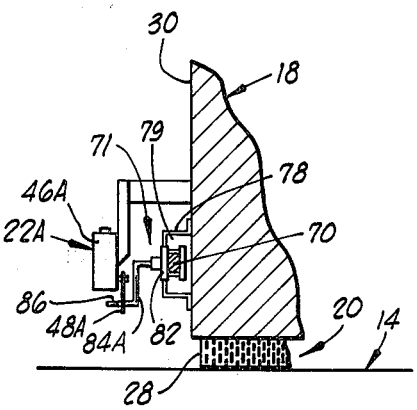
FIG. 4 is a close up view of a portion of the apparatus shown in FIG. 1 and taken generally along the line 4—4.

In one embodiment of the present invention, as shown in FIGS. 3 and 4, the work piece 20 is in the form of a drum type planer apparatus 28, such as that disclosed in the above mentioned U.S. Patent Application Ser. No. 672,326. A planer housing 30 is disposed over the planer apparatus 28 to contain road material cuttings produced via the planer apparatus 28 and to form a supportive means for other components of the present invention to be discussed below.

As shown in FIG. 2, the drive assembly 21 is connected to the frame 18 for moving the frame 18 in a forward direction 32 and generally includes a conventional prime mover 19, power transmission means (not detailed), a front drive track assembly 33, and left and right rear drive assemblies 34A, 34B connected to opposite sides of the frame 18. For purposes of the present invention, the rear drive track assemblies 34A and 34B are pivotally connected to the frame 18 so as to be pivotable about a rear control axis 36 disposed rearwardly of the work piece 20, and for convenience of description herein, the rear drive track assemblies 34A, 34B will be referred to respectively as left and right rear drive track assemblies, said designations arbitrarily assigned from the perspective of an operator of the machine 10 facing in the forward direction 32.

Each of the rear drive track assemblies 34A and 34B has a ground contact portion 38 which is in continuous driving contact with a surface portion of the roadway 14 as the frame 18 is moved in the forward direction 32 by the drive assembly 21. The ground contact portion 38 is further characterized as having a leading end 40 and a trailing end 42. The distance between the leading end 40 and the trailing end 42 (that is, the length of the ground contact portion 38) defines the effective span of the respective rear drive track assemblies 34A and 34B. Furthermore, each of the rear drive track assemblies 34A and 34B is of such construction that the ground contact portion 38 extends in a planar fashion between the leading and trailing ends 40 and 42 thereof regardless of the contour of the adjacent grade. Thus, the elevation above grade of the rear control axis 36 at each side of the frame 18 at any selected position relative to the roadway 14 will be indicative of, or proportional to, the average of the difference (if any difference exists) between the grade elevations of the leading and trailing ends 40 and 42 of the ground contact portion 38.

The grade sensor assembly 22A, shown more clearly in FIG. 3, is preferably connected to a portion of the frame 18 adjacent the work piece 20 in a selectively positionable manner, and is utilized to sense the first elevation control reference provided by the grade averaging apparatus 12. In response to sensing the first elevation control reference, the grade sensor assembly 22A provides a first elevation control signal to a portion of the elevation control assembly 25 indicative of, or proportional to, a deviation of the left end of the work piece 20 from the first elevation control reference, as will be made more apparent below. The grade sensor assembly 22A has a sensor actuating portion which specifically senses the first elevation control reference and, in response thereto, causes the grade sensor assembly 22A to provide the first elevation control signal. In the preferred embodiment, the grade sensor assembly 22A is in the form of a hydraulic sensor 46A having a sensing wand 48A which generally defines the sensor actuating portion thereof. More particularly, in the preferred embodiment, the sensing wand 48A is pivotally connected to the hydraulic sensor 46A and controls the positioning of a fluid valve (not shown) disposed therein, with the fluid valve controlling fluid flow to a portion of the elevation control assembly 25, as will be made more clear below.

The grade sensor assembly 22B, located near the opposite side 24 of the frame 18 is similar in construction to that described for the grade sensor assembly 22A, and comprises a corresponding hydraulic sensor 46B and sensing wand 48B. In like manner to that described for the grade sensor assembly 22A, the grade sensor assembly 22B provides a second elevation control signal via the positioning of a fluid valve that controls fluid flow to a portion of the elevation control assembly 25. As will be discussed more fully below, the grade sensor assembly 22B cooperates with other apparatus to sense the positioning of a second elevation control reference.

The elevation control assembly 25 is utilized to vary the elevation of the frame 18, and consequently of the work piece 20 in response to the elevation control signals provided via the grade sensor assemblies 22A and 22B. Thus, the elevation and slope of the work piece 20 is determined relative to the first and second elevation control references. In other words, the work piece 20 is selectively positionable in a vertical manner by the operation of the elevation control assembly which determines the elevation of the frame 18. In the preferred embodiment, the elevation control assembly 25 comprises hydraulic cylinders 34H and 35H that are connected respectively between the frame 18 and the left rear drive track assembly 34A and the right rear drive track assembly 34B. The hydraulic cylinders 34H, 35H, shown in broken line detail in FIGS. 1 and 2, serve to position the frame 18 vertically relative to the supporting rear drive track assemblies 34A and 34B. Also, the elevation control assembly 25 comprises a hydraulic cylinder 33H that is connected between the frame 18 and the front drive track assembly 33; the hydraulic cylinder 33H serves to position the front portion of the frame 18 vertically relative to the front drive assembly 33. The grade sensor assemblies 22A and 22B are in fluid communication with the elevation control assembly 25 by valves and conduits that are not shown in the drawings.

The grade averaging apparatus 12, as described above, generally comprises a front sensing assembly 58 for providing a forward elevation reference indicative of the average of the grade of a selected surface generally forwardly of the work piece 20; and a connecting assembly 60 supported jointly by the rear drive track assembly 34A and the front sensing assembly 58 for providing the first elevation control reference indicative of the average of the forward elevation reference and the rear elevation reference. The pivotal nature of the left rear drive track assembly 34A about the rear control axis 36 permits the left rear drive track 34A to serve as a track walking beam that provides a rear elevation reference indicative of the average grade that supports the left rear drive track assembly 34A.

The front sensing assembly 58 is defined as comprising a forward walking beam assembly 62 which is disposed forwardly of the work piece 20 and extends longitudinally along the roadway 14. The forward walking beam assembly 62 includes a beam 66 which is supported above the roadway 14 by a pair of caster wheels 68; and a generally horizontally extending, forward control axis 64 is defined as projecting through the midpoint of the beam 66.

The connecting assembly 60 comprising an averaging bar assembly and includes a connecting bar 70, and wand support assembly 71, and a swing arm 76. The swing arm 76 is pivotally connected to the beam 66 at the forward control axis 64 and normally extends upwardly and toward the roadworking apparatus 10, as can be seen in FIGS. 1 and 2. The bar 70 is pivotally connected at its rearward end 72 to the rear drive track assembly 34A near the rear control axis 36 at a point defining the rear elevation reference. At its opposite forward end 74, the bar 70 is pivotally connected to the swing arm 76 at a point defining the forward elevation reference. The rear elevation reference is in a fixed position in relation to the rear control axis 36 with the bar 70 being pivotal about the rear elevation reference. The front elevation reference is fixed relative to the front control axis 64 with the beam 66 being pivotal about the swing arm 76 (that is, the front control axis 64), and the swing arm 76 is pivotal about the bar 70 generally at the front elevation reference. The swing arm 76 is locked into a selected angular relation to the bar 70 by a conventional locking means, such as a set screw or other bolting means.

As shown in FIG. 4, a lifting bracket 78 is connected to the planer housing 30 and forms a slot 79 through which the bar 70 is disposed for limited vertical movement when the grade averaging assembly 12 is in use. As will be discussed more fully below, the lifting bracket 78 serves to lift the bar 70 so as to position the grade averaging assembly 12 in a grade clearing position when the road working machine 10 is being maneuvered into cutting position.

The bar 70 may be constructed of several pieces of bar stock, or the like, welded together to form an integral bar which conforms to the general shape of the side of the road working apparatus 10. In the preferred embodiment, the bar 70 is positioned relative to the frame 18, and the beam 66 is positioned relative to the bar 70, such that a medial portion of the bar 70 near the work piece 20 is substantially midway between the rear elevation reference and the front elevation reference. Of course, this may vary somewhat depending upon the position of the beam 66 relative to the bar 70.

From the above, it should be clear that if the bar 70 extended linearly between the rear elevation reference and the front elevation reference in a parallel relation with the roadway 14, the midpoint therebetween, as located on the bar 70, would substantially define an elevation above grade generally indicative of the average of the rear elevation reference and the front elevation reference, or in other words, the elevation control reference. However, in a more practical situation, since the bar 70 is constructed to conform to the shape of the road working apparatus 10, and because of the pivotal characteristic of the swing arm 76, the actual midpoint between the rear and front elevation references, as located on the bar 70, would not accurately define the elevation control reference. Thus, in the preferred embodiment, the wand support assembly 71 is utilized to indicate the elevation control reference which is the average of the rear elevation reference and the front elevation reference. That is, the wand support assembly 71 provides contact means for establishing communication between the sensor actuating portion, the sensing wand 48A, and the elevation control reference.

The wand support assembly 71 comprises a slide bracket 82 disposed over a medial portion of the bar 70, and a crank arm 84A pivotally connected to the slide bracket 82. The slide bracket 82 is selectively positionable along the bar 70, and a set screw or the like is used to lock the slide bracket in a fixed location on the bar 70. The crank arm 84A is selectively positionable relative to the slide bracket 82 and is locked in a selected position by means of a set screw or the like.

More particularly, the crank arm 84A is substantially S-shaped, as can be seen in FIG. 4, and extends away from the slide bracket 82, providing a reference surface 86 that extends generally parallel to the roadway 14. Since the reference surface 86 is locked in a fixed spatial relationship near the midpoint of the bar 70, the reference surface 86 is indicative of the position of the elevation control reference. In an assembled position of the above components, the sensing wand 48A is biased into contact with the reference surface 86 of the crank arm 84A such that the position of the sensing wand 48A relative to the hydraulic sensor 46A is determined by the position of the reference surface 86 relative to the frame 18. In other words, the sensor actuating portion (the sensing wand 48A) senses the elevation control reference (the reference surface 86), and in this manner, the sensing wand 48A and the wand support assembly 71 cooperate to form the contact means.

As mentioned above, the grade sensor assembly 22B is located on the opposite side 24 of the frame 18, and serves in a similar manner to that described for the grade sensor assembly 22A. That is, the sensing wand 48B of the grade sensor assembly 22B serves to sense the location of an arm 84B that extends from a conventional skid assembly 90 that is supported by the planer housing 30 along the opposite side 24. Of course, another grade averaging apparatus constructed in accordance with the present invention and similar to the grade averaging apparatus 12 could be attached to the side 24, and if this were done, the wand 48B would be actuated by a crank arm similar to the crank arm 84A. However, for the purpose of this disclosure, a conventional skid 90 is displayed in FIG. 2, and since the construction of such skids is known, details need not be given herein except to comment that the skid 90 is constructed to slide along a surface adjacent the opposite side 24 as the road working machine 10 moves along the roadway 14.

It will be recognized that a stringline could be set up for sensing by the wand 48B, in which case the wand 48B would be oriented to extend generally normal to the side 24. As will be discussed below, the use of a stringline is an option that may be desirable for a cutting pass close to the edge of a roadway. Another option of controlling the elevation of a portion of the frame 18 is a conventional slope control that would position one portion of the frame 18 at a constant setting relative to another portion of the frame 18. Since slope controls are well known, further discussion need not be provided.

Operation of the Present Invention

During a typical surfacing operation, such as a surface planing operation performed by the work piece 20, the machine 10 and the work piece 20 are initially aligned over the roadway 14 at a designated take-off area, with the work piece 20 being disposed generally transversely to the roadway 14. The take-off area generally defines the starting point of an initial pass to be made over the roadway 14 by the roadworking machine 10.

Before the machine 10 begins the initial pass, an elevation control reference is normally established in order to maintain the working depth of the work piece 20 at a constant elevation relative to the roadway surface. For the initial pass, the elevation control reference along the edge of the roadway 14 may be provided in a conventional manner such as by the use of a stringline along the edge, or if there should be a curbing surface or the like adjacent the roadway 14, the skid 90 (or a grade averaging assembly similar to the grade averaging assembly 12) may be utilized to provide the second elevation control reference for the initial pass. That is, the present grade averaging apparatus 12 can be used on either side of both sides or on the machine 10; or the grade averaging apparatus 12 can be used on one side of the machine 10 while the elevation of the opposite side of the machine 10 is controlled by a stringline, by conventional skid apparatus, or by a cross-slope control. In the interest of brevity herein, the present invention will be discussed with the machine 10 equipped with the skid 90 on one side of the machine and with the grade averaging apparatus 12 on the other side. The assignment of the machine 10 for the purpose of this discussion will be to remove the top surface of the roadway 14 to a uniform depth of a determined number of inches measured from the top of the existing grade.

In this mode of the machine 10, the elevation of the frame 18 would be controlled as follows. The first elevation control reference is provided by the grade averaging apparatus 12, and the grade sensor 22A provides the first elevation control signal to portion of the elevation control assembly 25 as the sensing wand 48A contacts the crank arm 84A of the grade averaging apparatus 12 as it moves along the surface adjacent the side 23 of the frame 18. The hydraulic cylinder 34H connected between the frame 18 and the left rear drive track 34A is actuated and positioned in response to this first elevation control signal.

Continuing the discussion of this mode of the machine 10, the second elevation control reference is provided by the skid apparatus 90, and the grade sensor 22B provides the second elevation control signal to a portion of the elevation control assembly 25 as the sensing wand 48B contacts the arm 84B as the skid 90 moves along the surface adjacent the side 24 of the frame 18. The hydraulic cylinder 33H connected between the frame 18 and the front drive track 33 is actuated and positioned in response to the second elevation control signal.

In operation, the roadway machine 10 is positioned to make the initial pass. The skid 90 is supported on a curb apron or the like along the edge of the roadway 14, and the grade averaging apparatus 12 is supported alongside the machine 10 on the existing pavement surface of the roadway 14. While in this position, the elevation of the frame 18 is altered by manually controlling the hydraulic cylinders 33H, 34H and 35H (by manual controls not shown) to position the work piece 20 in touching contact with the top of the roadway 14. That is, the axis of the work piece 20 will at this point have been placed in transverse and parallel relationship to the top surface of the roadway 14 since the slope of the axis of the work piece 20 will be the same as the transverse slope of the roadway 14. Once this has been achieved, the rotation of the work piece 20 is commenced, the entire frame 18 is lowered by the required number of inches necessary to achieve the specified depth of cut. At this point, the machine 10 is advanced until the rear drive track assemblies are positioned on the finish grade 16, and the hydraulic cylinder 35H is locked in a fixed position to lock the rear drive track assembly to grade. This establishes the rear portion of the frame 18 on the side 24 at a fixed elevation above the newly cut finish grade 16. The elevation control assembly is now set on its automatic mode to maintain the specified cutting depth as controlled by the grade sensor assemblies 22A and 22B that respectively control the elevation of the frame 18 by effecting the extension, respectively, of the hydraulic cylinders 34H and 33H. At this point, the roadway machine 10 is prepared for cutting advancement along the roadway 14.

As the machine 10 moves forward, an irregularity in the existing grade, were it not for the present invention, would cause the work piece 20 to deviate downwardly to an elevation below the desired cutting depth. However, the first elevation control signal provided by the grade averaging apparatus 12 of the present invention will off-set this tendency by signalling the elevation control assembly to change the elevation of the frame 18 (and consequently the elevation of the work piece 20) by an amount proportional to an average of forwardly and rearwardly sensed grade elevations. In this way, the work piece 20 will be maintained at a more uniform cutting depth in relation to the average grade elevation of the roadway 14 as indicated by the grade averaging apparatus 12.

The work piece 20 forms a work path as the road working machine 10 makes its initial pass over the roadway 14, with the rear drive track assemblies 34A and 34B following the work path in the wake of the work piece 20 when the distance span of the rear drive track assemblies 34A and 34B is less than the transverse length of the work piece 20. When a planing operation is being performed by the machine 10, the work path represents that portion of the roadway 14 which has been planed, designated as the finish grade 16. As mentioned above, the elevation controls must be adjusted once the rear drive tracks 34A and 34B are resting in the work path so as to obtain the desired cutting depth.

After the initial pass has been completed, the road working machine 10 is usually positioned to make at least one, and generally several subsequent passes adjacent the initial pass until the entire roadway 14 has been exposed to the planing operation. During all subsequent passes, as in the initial pass, the grade averaging apparatus 12 is again utilized to provide the first elevation control reference, and the skid apparatus 90 again is positioned to provide the second elevation control reference. However, during the subsequent passes, the skid 90 will slide along the cut work path of the previous pass, necessitating adjustment of the elevation of the frame 18 once again as described above for the commencement of the initial pass.

More particularly, with respect to the operation of the grade averaging apparatus 12 of the present invention, at the beginning of each pass of the roadway machine 10, the walking beam assembly 62 is positioned such that the caster wheels 68 are riding on the selected grade reference along the roadway 14. The swing arm 76 is locked at a selected angular position, and the crank arm 84 is positioned along the connecting bar 70 to engage the sensing wand 48A for proper sensing operation. As the machine 10 moves forward, the caster wheels 68 will follow the contour of the contacted roadway surface, and the rear drive track assembly 34A will follow the contour of the surface of the work path. Any deviation, in the surface of the roadway 14 will be sensed by the front sensing assembly 58 (that is, by the forward walking beam assembly 62), and any deviation in the surface of the work path will be sensed by the rear drive track assembly 34A that serves as a rear walking beam apparatus. The forward elevation reference sensed by the forward walking beam assembly 62 will be averaged with the rear elevation reference that is sensed by the left rear drive track assembly 34A, with the elevation of the averaging bar 70 being effected thereby. Therefore, the first elevation control signal provided by the hydraulic sensor 46A will be indicative of, or proportional to, a twice-averaged deviation, as opposed to responding directly to any given deviation. Thus, the cutting depth of the work piece 20 will be varied as necessary to maintain a more uniform cutting depth with each pass.

In further explanation, the reason that deviations are twice-averaged is that the left rear drive track 34A also serves as a walking beam to average depressions traversed thereby. When the left rear drive track assembly 34A travels over a depression in the work path, the elevation of the mid-point of the rear drive track assembly 34A will be affected only if the distance across the depression is greater than half the distance from the leading end 40 to the trailing end 42, due to the planar nature of the ground contact portion 38 of the rear drive track assembly 34A. Even if the depression, or surface irregularity, in the work path is of sufficient size to be sensed by the left rear drive track assembly 34A, the elevation of the rear control axis 36 will be averaged with the grade concurrently sensed by the forward walking beam assembly 62 to determine the elevation of the connecting bar 70, and consequently the elevation of the crank arm 84A.

After the road working machine 10 finishes a pass and is maneuvered to its next cutting position, the portability and simplicity of operation of the grade averaging assembly 12 will be appreciated. It will be noted that the rearward end 72 of the connecting bar 70 is pivotally supported by the left rear drive track assembly 34 at a position that provides substantial clearance above the surrounding terrain. As for the front sensing assembly 58, this portion of the grade averaging assembly 12 is moved to a position that clears the terrain by the operation of the lifting bracket 78 as the frame 18 is elevated. That is, when the frame 18 is elevated relative to the track assemblies 33, 34A, the lifting bracket 78 engages the connecting bar 70 and causes the caster 68 of the front sensing assembly 58 to clear the terrain. When the casters 68 clear of the terrain, the machine 10 can be easily positioned without concern as to the grade averaging assembly 12.

In practice, when the machine 10 has completed a pass, the operator will remove the elevation control assembly from its automatic mode and will manually control the hydraulic cylinders to elevate the frame 18 to a determined level so as to lift the grade averaging apparatus 12 to a grade clearing position. Once this has been performed, the machine 10 can be maneuvered into position for its next cutting pass. Once this position is achieved, the frame 18 can be lowered by manually controlling the hydraulic cylinders connected to the track assemblies 33 and 34A, 34B, to the elevation that the frame 18 occupied during the previous pass, thereby lowering the front assembly 58 onto the roadway surface 14 to be utilized for this pass. Only minor elevation adjustment is usually necessary after which the operator can place the elevation control assembly back into its automatic control mode. If the elevation of the frame 18 deviates from the required elevation to null the grade sensor assemblies 22A and 22B, the elevation of the frame 18 will automatically be reset for the start of this pass because of the determined cutting depth having been before established. This demonstrates the ease of establishing an elevation control reference afforded by the portable grade averaging apparatus 12 of the present invention.

As mentioned above, another grade averaging apparatus constructed in accordance with the present invention and which is similar to the grade averaging apparatus 12 can be utilized alongside the opposite side 24 of the frame 18 instead of using the skid apparatus 90. In practice, since the uniformity of the cutting depth achieved by using the grade averaging apparatus 12 is quite good, it has been determined that a conventional skid 90 may be used on one side of the machine 10 where the skid 90 is to slidingly contact a curb apron during the initial pass and the skid 90 slidingly contacts the work path of the previous pass during subsequent passes of the roadway machine 10.

It is believed that it will be clear from the above disclosure that the present invention is well adapted to carry out the objects and to attain the ends and advantages herein mentioned, as well as those which are inherent therein. While a presently preferred embodiment of the invention has been described for the purpose of this disclosure, numerous changes may be made which will readily suggest themselves to those skilled in the art and which are encompassed within the spirit of the invention disclosed and as defined in the appended claims.

What is claimed is:

1. In combination with a road working machine having a frame supporting a work piece, the frame supported by at least one rear drive track pivotally connected thereto, and the elevation of the work piece determined by an elevation control device sensing an external elevation control reference, the improvement comprising:

front sensing means for providing a forward elevation reference indicative of the average of the grade of a selected reference surface generally forwardly of the work piece, the rear drive track providing a rear elevation reference indicative of the average grade of the roadway surface supporting the rear drive track; and connecting means pivotally connected to the front sensing means and pivotally connected to the rear drive track for providing the elevation control reference indicative of the average of the forward elevation reference and the rear elevation reference.

2. The apparatus of claim 1 further comprising:

lifting means for selectively lifting the front sensing means to a grade clearing position.

3. The apparatus of claim 2 wherein the rear drive track is pivotally connected to the frame about a rear control axis, and the connecting means is further characterized as comprising:

a bar member having a forward end and a rear end, the rear end pivotally connected to the rear drive track at a point defining the rear elevation reference, the position of the rear elevation reference being fixed relative to the rear control axis, the forward end of the bar member being supported by the front sensing means.

4. The apparatus of claim 3 wherein the front sensing means is defined further as comprising:

a swing arm connected to the forward end of the bar member;

a walking beam pivotally connected to the swing arm and pivotal relative thereto about a front control axis, the position of the forward elevation reference being determined by the front control axis; and support means supportable on the selected reference surface for supporting the walking beam.

5. The apparatus of claim 4 wherein the support means is characterized as comprising at least one caster supporting each end of the walking beam and rollingly engagable with the selected reference surface.

6. The apparatus of claim 5 wherein the connecting means is further characterized as comprising a selectively positionable crank arm connected to a medial portion of the bar member, a portion of the crank arm defining a surface indicative of the position of the elevation control reference.

7. The apparatus of claim 6 wherein the swing arm is pivotally connected to the bar member whereby the beam is selectively positionable in relation to the bar.

8. In combination with a road working machine having a frame supported by and pivotally connected to at least one drive track assembly, the elevation of the frame determinable by an elevation control device sensing an external elevation control reference, the improvement comprising:

a first walking beam supportable on a selected reference surface; and a bar member having a first end and a second end, the first end pivotally connected to the first walking beam near the midpoint thereof, the second end of the bar member pivotally connected to the drive track assembly so that the drive track assembly serves as a second walking beam, a portion of the bar member providing the elevation control reference.

9. The apparatus of claim 8 further comprising:

lifting means for lifting the first walking beam to a grade clearing position.

10. The apparatus of claim 9 wherein the walking beam is supported by at least one caster wheel near each end thereof.

11. The apparatus of claim 10 wherein a crank arm member is supported by the bar member, a portion of the crank arm defining a surface the position of which is indicative of the elevation control reference.

12. The apparatus of claim 9 wherein the lifting means is characterized as comprising a lifting bracket supported by the road working machine and disposed to provide limited vertical travel of the bar member when in use and to lift the bar member to position the first walking beam in the grade clearing position when the frame is elevated to a predetermined level.

13. In combination with a road working maching having a frame drivingly supported by a front drive track assembly and by first and second rear drive track assemblies pivotally connected to the frame, the frame supporting a work piece for engagement with the surface of a roadway, the improvement comprising:

front sensing means supported by the frame along a selected first side thereof for providing a forward elevation reference indicative of the average grade of a selected reference surface along the first side and generally forwardly of the work piece, the first rear drive track assembly providing a rear elevation reference indicative of the average grade of the roadway surface supporting the first rear drive track assembly;

connecting means supported by the front sensing means and pivotally connected to the first rear drive track assembly for providing an elevation control reference indicative of the average of the forward elevation reference and the rear elevation reference;

first elevation control means supported by the frame and contacting the connecting means for providing a first elevation control signal in response to the first elevation control reference;

first hydraulic means connecting the frame to the first rear drive track assembly for establishing the elevation of a first rear portion of the frame in response to the first elevation control signal;

averaging means supported along the opposite side of the frame for providing a second elevation control reference indicative of a selected reference surface along the second side;

second elevation control means supported by the frame and contacting the averaging means for providing a second elevation control signal in response to the second elevation control reference; and front hydraulic means connecting the frame to the front drive track assembly for establishing the elevation of a front portion of the frame in response to the second elevation control signal.

14. The combination of claim 13 further comprising:

second hydraulic means connecting the frame to the second rear drive track assembly for selectively establishing the elevation of a second rear portion of the frame.

15. The apparatus of claim 14 further comprising:

lifting means for selectively lifting the front sensing means to a grade clearing position.

16. The apparatus of claim 15 wherein the first rear drive track assembly is pivotally connected to the frame about a rear control axis, and the connecting means is further characterized as comprising:

a bar member having a forward end and a rear end, the rear end pivotally connected to the first rear drive track assembly at a point defining the rear elevation reference, the position of the rear elevation being fixed relative to the rear control axis, the forward end of the bar member being supported by the front sensing means.

17. The apparatus of claim 16 wherein the front sensing means is defined further as comprising:

a swing arm connected to the forward end of the bar member;

a walking beam pivotally connected to the swing arm and pivotal relative thereto about a front control axis, the position of the forward elevation reference being determined by the front control axis; and support means supportable on the selected reference surface for supporting the walking beam.

18. The apparatus of claim 17 wherein the support means is characterized as comprising at least one caster supporting each end of the walking beam and rollingly engagable with the selected reference surface.

19. The apparatus of claim 18 wherein the connecting means is further characterized as comprising a selectively positionable crank arm connected to a medial portion of the bar member, a portion of the crank arm defining a surface indicative of the position of the elevation control reference.

20. The apparatus of claim 19 wherein the swing arm is pivotally connected to the bar member whereby the beam is selectively positionable in relation to the bar.

21. The apparatus of claim 20 wherein the lifting means is characterized as comprising a lifting bracket supported by the road working machine and disposed to provide limited vertical travel of the bar member when in use and to lift the bar member to position the first walking beam in the grade clearing position when the frame is elevated to a predetermined level.

* * * * *

UNITED STATES PATENT OFFICE

CERTIFICATE OF CORRECTION

Patent No. 4,140,420 Dated February 20, 1979

Inventor(s) George W. Swisher, Jr and Thomas L. Steele

It is certified that error appears in the above-identified patent and that said Letters Patent are hereby corrected as shown below:

Patent Office:

Column 4, line 11, "working" should be --work--.

Column 6, line 24, "and" second occurrence should be -- a --.

Column 8, line 35 "of" should be --or on--.

Column 8, line 35, "or on" should be --of--.

Ours:

Column 13, line 12, "maching" should be --machine--.

Signed and Sealed this

Fifth Day of June 1979

[SEAL]

Attest:

RUTH C. MASON
Attesting Officer

DONALD W. BANNER
Commissioner of Patents and Trademarks